US006641258B2

(12) United States Patent
Ogasawara

(10) Patent No.: US 6,641,258 B2
(45) Date of Patent: Nov. 4, 2003

(54) INTERMEDIATE TRANSFER RECORDING APPARATUS FOR RETRANSFERRING PRIMARY TRANSFER IMAGE ON DISK-LIKE TRANSFER MEDIUM

(75) Inventor: Masashi Ogasawara, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/163,394

(22) Filed: Jun. 5, 2002

(65) Prior Publication Data

US 2002/0186290 A1 Dec. 12, 2002

(30) Foreign Application Priority Data

Jun. 7, 2001 (JP) ..... 2001-172298

(51) Int. Cl.[7] ..... B41J 2/01
(52) U.S. Cl. ..... 347/103
(58) Field of Search ..... 347/103, 120, 347/20, 111, 159, 141, 155, 127, 128, 17, 154, 61; 399/271, 290, 292, 293, 294, 33, 67, 320

(56) References Cited

U.S. PATENT DOCUMENTS 5,798,161 A 8/1998 Kita et al.
6,097,415 A 8/2000 Kita et al.
6,261,012 B1 7/2001 Haas et al.

*Primary Examiner*—Raquel Yvette Gordon
(74) *Attorney, Agent, or Firm*—Brinks, Hofer Gilson & Lione

(57) ABSTRACT

A dummy image is formed on a periphery of a retransfer image region on a transfer medium where a primary transfer image is not retransferred on the transfer medium when the primary transfer image is formed on the intermediate transfer film. As the result, peeling tension exerted on the intermediate transfer film is approximately even in a width direction, the primary transfer image is retransferred onto the transfer medium without changing of a transfer condition, and an optimal retransfer condition can be obtained.

12 Claims, 4 Drawing Sheets

INTERMEDIATE TRANSFER RECORDING APPARATUS FOR RETRANSFERRING PRIMARY TRANSFER IMAGE ON DISK-LIKE TRANSFER MEDIUM

BACKGROUND OF THE INVENTION

1. Field of the Invention

This invention relates to an intermediate transfer recording apparatus in which ink of an ink film is transferred onto an intermediate transfer film by means of a line thermal head to form a primary transfer image, and the primary transfer image is retransferred onto a disk-like transfer medium by means of retransfer means to thereby form an image on the transfer medium.

2. Description of the Related Art

Heretofore, the intermediate transfer recording apparatus in which ink of an ink film is transferred onto an intermediate transfer film comprising a long resin film consisting of resin such as polyethyleneterephthalate by means of a line thermal head to form a primary transfer image, and the primary transfer image is retransferred onto a transfer medium by means of retransfer means to thereby form an image on the transfer medium has been used as the recording apparatus for forming an image on various transfer media such as optical disks like CDs and cards.

In the case of a conventional intermediate transfer recording apparatus as described hereinabove, in the primary transfer image forming section, the line thermal head is brought into the head-down state in which the line thermal head is pressed on a platen roller with interposition of an ink film and an intermediate transfer film in this order, and some heating elements of the line thermal head are heated selectively based on image forming information while moving the ink film and the intermediate transfer film in this state to thereby partially melt or sublimate and transfer the ink of the ink film onto the intermediate transfer film. As the result, for example, a reverse image that is the primary transfer image for the area corresponding to an image recording region of a transfer medium is formed on the intermediate transfer film.

Furthermore, in the case where a multicolor image is formed on a transfer medium, a multicolor primary image is formed by means of so-called swing-back technique as described hereunder. A multicolor ink film on which a plurality of color ink regions are arranged so that different colors are repeated adjacently in a longitudinal direction is used as an ink film. At first, a reverse image of the first color ink that is carried on the multicolor ink film is formed on an intermediate transfer film. Then, a line thermal head is brought into a head-up state in which the line thermal head is separated from a platen, and the intermediate transfer film is moved reversely in this state. The reverse image formed with the first color ink is returned to the transfer position for start alignment, and a reverse image of the next color is transferred on the reverse image of the first color one on the other.

In detail, in the case where a full-color image is formed, a multicolor ink film on which a plurality of three-color ink regions, each of which consists of three colors, for example, C (cyan), M (magenta), and Y (yellow) are arranged in this order so as to be repeated adjacently in the longitudinal direction and which has color-discrimination marks on the boundary between different ink regions is used.

In detail, at first a register mark that has been marked previously on the intermediate transfer film is detected, and a C-color reverse image for the area corresponding to the recording region of the transfer medium is formed on the intermediate transfer film by using the register mark as the reference by use of a C-color ink region of the multicolor ink film. Next, the intermediate transfer film that has been moved in the primary transfer image forming operation is moved reversely and the C-color reverse image that has been formed on the intermediate transfer film is aligned, and an M-color ink region that is adjacent to the C-color of the multicolor ink film is aligned and an M-color reverse image is formed on the C-color reverse image that has been formed on the intermediate transfer film by use of an M-color ink region of the multicolor ink film. Subsequently, a Y-color ink region is aligned in the same manner as described hereinabove, a Y-color reverse image is formed additionally on the intermediate transfer film by use of a Y-color ink region of the multicolor ink film to thereby form a full-color primary transfer image for the area corresponding to the recording region of the transfer medium on the intermediate transfer film.

Thereafter, the intermediate transfer film is moved so that the primary transfer image that has been formed on the intermediate transfer film is moved to the position located just before the retransfer position. Then, the primary transfer image is registered with a transfer medium by use of a register mark formed on the intermediate transfer film, the primary transfer image that has been formed on the intermediate transfer film is melted or sublimated to retransfer and fix it on the transfer medium by heating and pressing by use of the retransfer means comprising a heating roller in the retransfer section to thereby form a desired image on the transfer medium.

However, the conventional primary transfer image formed on an intermediate transfer film only forms a primary transfer image for a area corresponding to a recording region of a transfer medium. Therefore, in the case where a primary transfer image is retransferred onto a disk-like transfer medium such as a CD, because the transfer medium is circular, the central portion of the primary transfer image of the intermediate transfer film is brought into contact with the disk at the start of retransfer, only the central portion is adhered on the transfer medium and both sides are not adhered. As a result, the peeling tension exerted on the intermediate transfer film is differentiated in the width direction of the intermediate transfer film. The adhered region of the primary transfer image on the transfer medium increases as the retransfer proceeds, and then decreases as the retransfer further proceeds after the middle point. As a result, the transfer condition for the transfer medium is not constant, good transfer condition cannot be obtained, and a good quality image cannot be formed on the transfer medium, which is disadvantageous.

The present invention has been accomplished in view of the abovementioned problem, it is the object of the present invention to provide an intermediate transfer recording apparatus that operates a process in which an adhesion region of an image is maintained constant throughout a retransfer operation from the start of retransfer to the end of the retransfer when a primary image of the intermediate transfer film is retransferred onto a disk-like transfer medium to bring about an optimal transfer condition to allow the formation of a good image recorded on the transfer medium.

To achieve the abovementioned object, an intermediate transfer recording apparatus in accordance with the present invention is characterized in that a dummy image is formed on a periphery of a retransfer image region on the transfer medium where the primary transfer image is not retransferred when the primary transfer image is formed on the intermediate transfer film. Because the abovementioned structure is employed, the dummy image is formed on a region where the primary transfer image is not retransferred on the transfer medium on the periphery of the retransfer image region corresponding to the transfer medium when the primary transfer image is formed on the intermediate transfer film. Thereby, the dummy image is in contact with an upper surface of a guide member of the transfer medium on the periphery of the transfer medium when the primary image is retransferred onto the transfer medium, and heated and pressed by means of heating means. The dummy image is retransferred in the same manner as in the case where the primary image is retransferred onto the transfer medium, and the retransfer region is maintained approximately constant throughout the retransfer operation, peeling tension exerted on the intermediate transfer film is approximately even in a width direction, and the primary transfer image is retransferred onto the transfer medium without changing of a transfer condition. As the result, an optimal retransfer condition can be obtained.

Furthermore, the intermediate transfer recording apparatus in accordance with the present invention is additionally characterized in that the dummy image is formed on the periphery of the primary transfer image with a predetermined space between the dummy image and the primary transfer image. Because the abovementioned structure is employed, retransfer of the dummy image onto the transfer medium is prevented even if registration between the primary image and the transfer medium deviates slightly when the primary image is retransferred onto the transfer medium.

Furthermore, the intermediate transfer recording apparatus in accordance with the present invention is additionally characterized in that an outside peripheral configuration of the dummy image is rectangular. Because the abovementioned structure is employed, the retransfer region is maintained constant throughout the retransfer operation from the start when the primary image is retransferred onto the transfer medium, and as the result a retransfer condition is optimized.

Furthermore, the intermediate transfer recording apparatus in accordance with the present invention is additionally characterized in that the dummy image is formed with a density lower than that of the primary transfer image. Because the abovementioned structure is employed, the power supplied to the thermal head can be reduced for the dummy image forming region, and as a result power consumption can be reduced.

Furthermore, the intermediate transfer recording apparatus in accordance with the present invention is additionally characterized in that the dummy image can be formed using at least one color ink layer of a multicolor ink film and the dummy image is formed with thermal energy that is smaller than that of the primary transfer medium. Because the abovementioned structure is employed, not only is power saved but also the time required to form the dummy image is shortened in comparison with the case in which all of the color ink layers are used for forming the dummy image.

DESCRIPTION OF THE PREFERRED EMBODIMENTS

Figure 1:
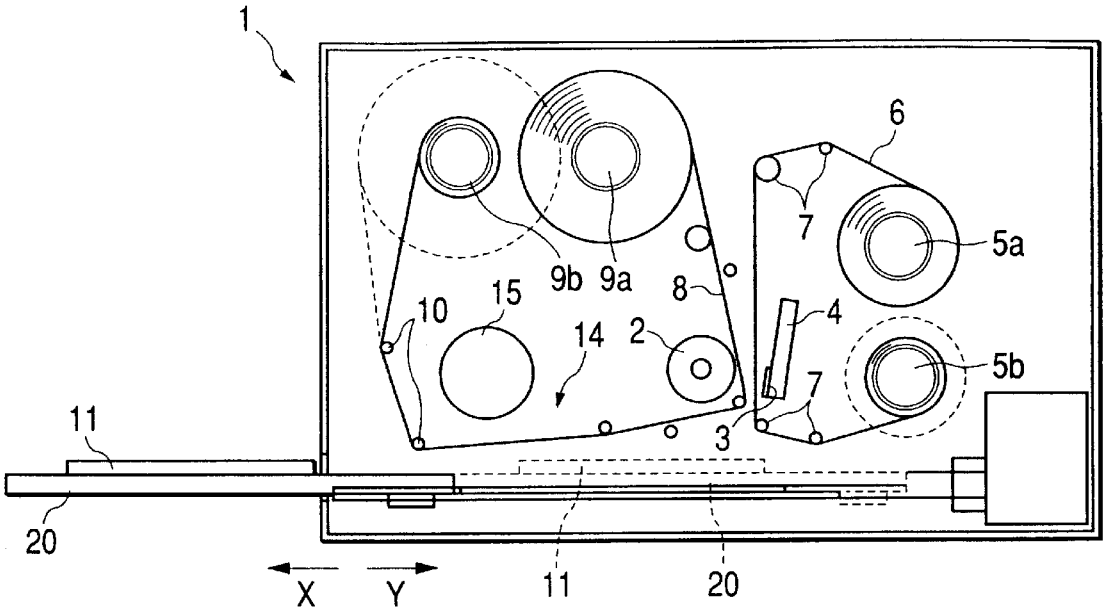
FIG. 1 is a partial explanatory diagram showing the first embodiment of an intermediate transfer recording apparatus in accordance with the present invention.

FIG. 1 shows an intermediate transfer recording apparatus in accordance with the present embodiment. As shown in FIG. 1, a recording apparatus body 1 of the intermediate transfer recording apparatus is provided with a cylindrical platen roller 2 rotatably, a line thermal head 3 on the surface of which a plurality of heating elements (not shown in the drawing) are arranged fixed to a head mounting base 4 at a position facing the platen roller 2, wherein the line thermal head 3 is disposed so as to be in/off contact with the platen roller 2 when the head mounting base 4 is turned.

A feeding side film roller 5*a* and a winding side film roller 5*b* on which both ends of a long ink film 6 are fixed and wound are provided on one side of the recording apparatus body 1. The ink film 6, which is wound on the film rollers 5, is drawn between the platen roller 2 and the line thermal head 3 with guiding by means of a plurality of guide rollers 7.

A retransfer section 14 for retransferring the primary transfer image 12 formed on the intermediate transfer film 8 onto a disk-like transfer medium 11 such as a CD is provided downstream from the platen roller 2 in the moving route of the intermediate transfer film 8. In the retransfer section 14, a heating roller 15 that serves as a retransfer roller and heating and pressing means is disposed movably in the vertical direction in FIG. 1 at a position above the intermediate transfer film 8.

Figure 2:
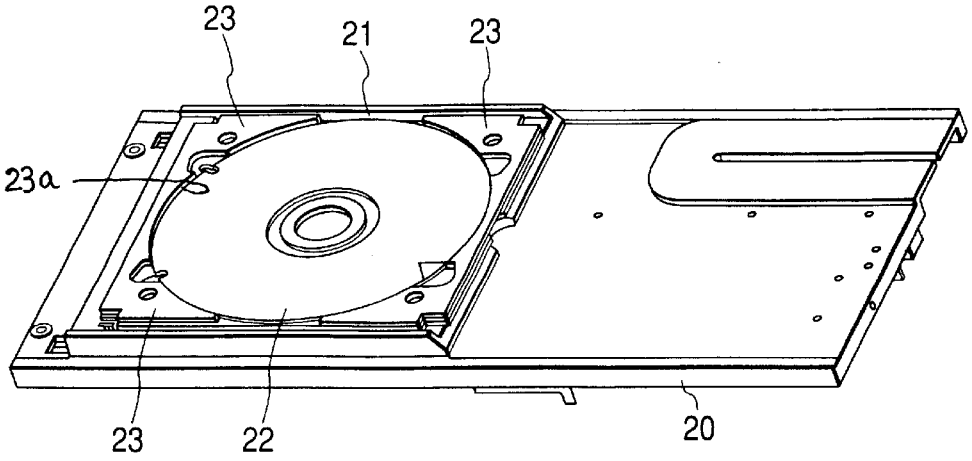
FIG. 2 is a perspective view showing the structure of a moving table of the intermediate transfer recording apparatus in the embodiment shown in FIG. 1.

Furthermore, a moving table 20 for moving the transfer medium 11 is disposed so as to be moved in the direction of arrows X and Yin the lower inside portion of the recording apparatus body 1, and as shown in FIG. 2, a holding tray 21 on which the transfer medium 11 is placed and held is provided so as to face the heating roller 15 with interposition of the intermediate transfer film 8 on the top surface of the moving table 20. The moving table 20 is structured to move reciprocally between the position (position indicated with a solid line) where the moving tray 21 is exposed outside the recording apparatus body 1 and the position (position indicated with a dashed line) that is apart to the right side in FIG. 1 from the position where the left side end in FIG. 1 of the transfer medium 11 placed on the holding tray 21 is in contact with the heating roller 15.

Furthermore, as shown in FIG. 2, a guide member 23 for guiding the peripheral edge of the transfer medium 11 is disposed on the periphery of the holding portion 22 of the holding tray 21 on the moving table 20 on which the transfer medium 11 is held, and an inside peripheral surface 23*a* of the guide member 23 is formed in a circular arc to extend along the outside peripheral surface of the transfer medium 11.

Figure 3:
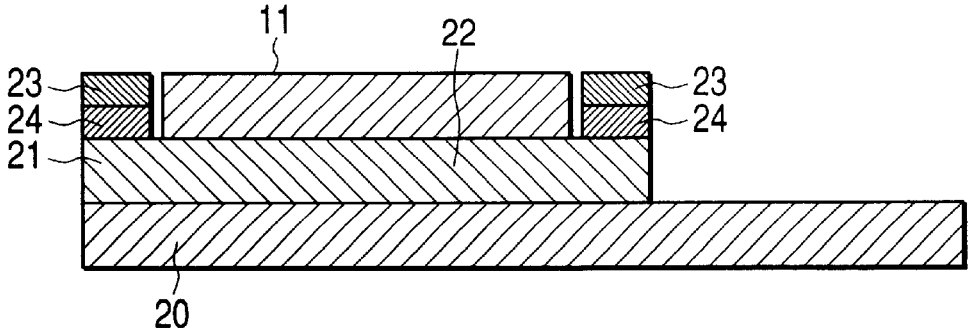
FIG. 3 is a partial cross sectional view for describing the relative vertical level relation between a guide and a transfer medium that appears when the transfer medium is held on a mounting tray of the intermediate transfer recording apparatus in the embodiment shown in FIG. 1.

Furthermore, the guide member 23 is formed so that the vertical position of the surface of the guide member 23 is at the same level as the vertical position of the surface of the transfer medium 11 when the transfer medium 11 is placed on the holding portion 22 as shown in FIG. 3. Thereby, when the transfer medium 11 is placed on the holding tray 21 and the heating roller 15 is lowered to retransfer the primary transfer image 12 that has been formed on the intermediate transfer film 8 onto the transfer medium 11, the heating roller 15 is brought into contact with the surface of the transfer medium 11 and the surface of the guide member 23 that are positioned at the same vertical level with interposition of the intermediate transfer film 8.

The surface of the guide member 23 is coated with a fluorine material to prevent the ink of a dummy image 13 (refer to FIG. 4) formed on the intermediate transfer film 8 from being transferred. Furthermore, an elastic member 24 consisting of rubber material is disposed under the guide member 23. The elastic member 24 may be optional.

The intermediate transfer recording apparatus as described hereinabove is operated for recording the image onto the transfer medium 11 as described hereinafter.

At first, the moving table 20 is moved in the direction of the arrow X to the position where the holding tray 21 is exposed outside the recording apparatus body 1 (position indicated with a solid line shown in FIG. 1) and the transfer medium 11 is placed on the holding tray 21, and then the moving table 20 is moved in the direction of the arrow Y to return it to the retransfer section 14 (position indicated with a broken line shown in FIG. 1).

Figure 4:
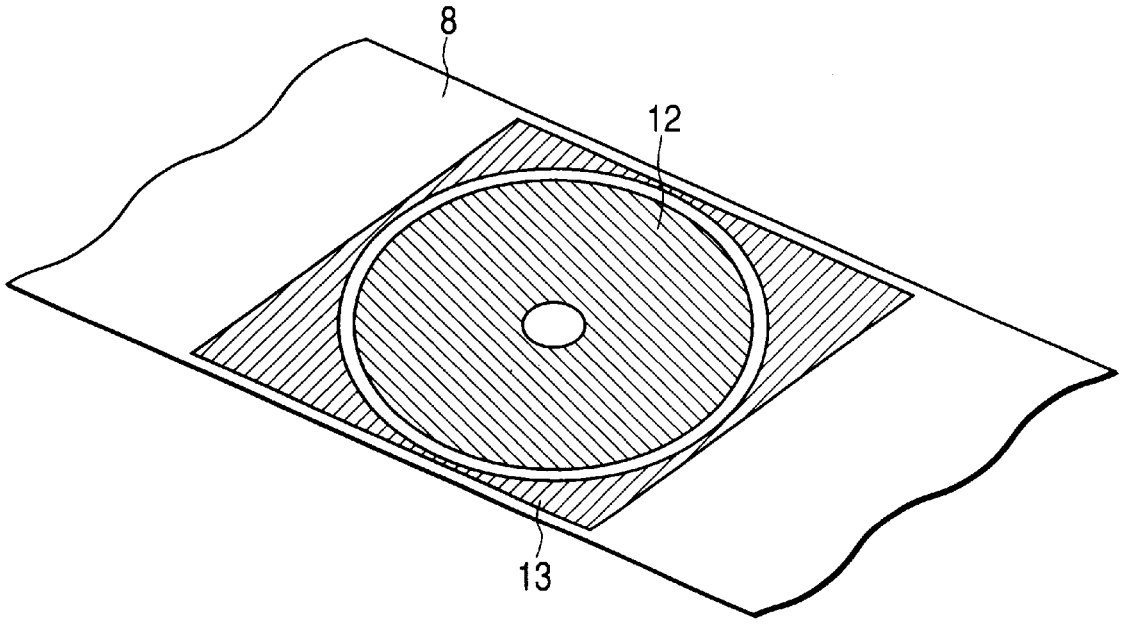
FIG. 4 is an explanatory diagram showing the primary transfer image and the dummy image formed on the intermediate transfer film in the embodiment shown in FIG. 1.

Next, the line thermal head 3 is brought into pressure contact with the platen roller 2 with interposition of the ink film 6 and intermediate transfer film 8. In this state, the platen roller 2 is rotated, the plurality of heating elements of the line thermal head 3 are driven selectively to transfer the ink of the ink film 6 onto the intermediate transfer film 8 while the ink film 6 and the intermediate transfer film 8 are being fed, that is, while the ink film 6 and the intermediate transfer film 8 are being wound on the winding side film roller 5*b* and the winding side roller 9*b* respectively, and the primary transfer image 12 that is a circular reverse image corresponding to the recording region of the transfer medium 11 is formed resultantly. At that time, when the primary transfer image 12 is formed, the dummy image 13 having a rectangular outside configuration is formed simultaneously with the formation of the primary transfer image 12 with a narrow space of 1 to 2 mm between the dummy image 13 and the primary transfer image 12 on the periphery of the circular intermediate transfer image as shown in FIG. 4. At that time, the dummy image 13 may be formed with a thermal energy of the thermal head 3 that is lower than the thermal energy applied to the primary transfer image 12 so that the density of the dummy image 13 is lower than the density of the primary transfer image 12 as required.

The intermediate transfer film 8 on which the primary transfer image 12 has been formed is moved to the retransfer section 14. At that time, an optical sensor (not shown in the drawing) provided in the recording apparatus body 1 detects a position detection mark (not shown in the drawing) formed on the intermediate transfer film 8, and the intermediate transfer film 8 is registered so that the position of the primary transfer image 12 coincides with the image forming position of the transfer medium 11.

Next, the heating roller 15 that is heated to a desired temperature is moved down. At first, the heating roller 15 is brought into contact with the edge of the holding tray 21 with interposition of the portion where the ink of the intermediate transfer film 8 is not transferred. Starting from this state, the moving table 20 and the intermediate transfer film 8 are moved in the direction of the arrow X as shown in FIG. 1. When the moving table 20 is moved until the heating roller 15 is brought into contact with the head of the primary transfer image 12 formed on the intermediate transfer film 8 and the head of the transfer medium 11, the heating roller 15 is brought into contact with the surface of the transfer medium 11 and the surface of the guide member 23 that are positioned at the same vertical level with interposition of the intermediate transfer film 8.

Furthermore, at that time, when the heating roller 15 is brought into contact with the head of the primary transfer image 12 formed on the intermediate transfer film 8 and the head of the transfer medium 11, the head of the dummy image 13 formed on the periphery of the primary transfer image 12 is brought into contact with the surface of the guide member 23 by means of the heating roller 15.

Furthermore, the moving table 20 is moved in the direction of the arrow X as shown in FIG. 1, and the intermediate transfer film 8 is moved. At that time, because the intermediate transfer film 8 is moved at the same speed and in the same direction as those of the moving table 20, the transfer medium 11 held on the holding tray 21 of the moving table 20, the primary transfer image 12 on the intermediate transfer film 8, and the dummy image 13 are moved at the same speed in the same direction.

Thereby, the primary transfer image 12 on the intermediate transfer film 8 that is heated and pressed by means of the heating roller 15 is melted and pressed on the transfer medium 11 and retransferred onto the transfer medium 11, the intermediate transfer film 8 is peeled off the surface of the transfer medium 11, and as a result an image is recorded on the surface of the transfer medium 11.

Because the dummy image 13 formed on the periphery of the primary transfer image 12 is also in pressure contact with the surface of the guide member 23 by means of the heating roller 15 when the primary transfer image 12 is retransferred, the ink of the dummy image 13 is also heated and remelted by means of the heating roller 15, and the remelted ink adheres on the surface of the guide member 23 and then peeled off from the surface of the guide member 23 as the intermediate transfer film 8 is moved.

Because the dummy image 13 formed on the periphery of the primary transfer image 12 is remelted and adheres on the surface of the guide member 23 when the primary transfer image 12 is transferred onto the transfer medium 11 as described hereinabove, the tension exerted on the intermediate transfer film 8 is even in the width direction, and the intermediate transfer film 8 is peeled off the transfer medium 11 under good condition. As a result, the primary transfer image 12 of the intermediate transfer film 8 is retransferred consistently to the transfer medium 11, and good quality image is obtained.

Because fluorine material is coated on the surface of the guide member 23 as described hereinabove to prevent the ink from being transferred and because molten ink of the dummy image 13 adheres on the intermediate transfer film 8 more strongly than on the surface of the guide member 23, the ink that adheres on the surface of the guide member 23 temporarily adheres on the intermediate transfer film 8 side as the intermediate transfer film 8 is peeled off, and the ink of the dummy image 13 is peeled off the surface of the guide member 23. As a result, the ink is not transferred on the surface of the guide member 23.

Next, an embodiment in which a full-color image is recorded on the transfer medium 11 will be described hereinafter.

Figure 5:
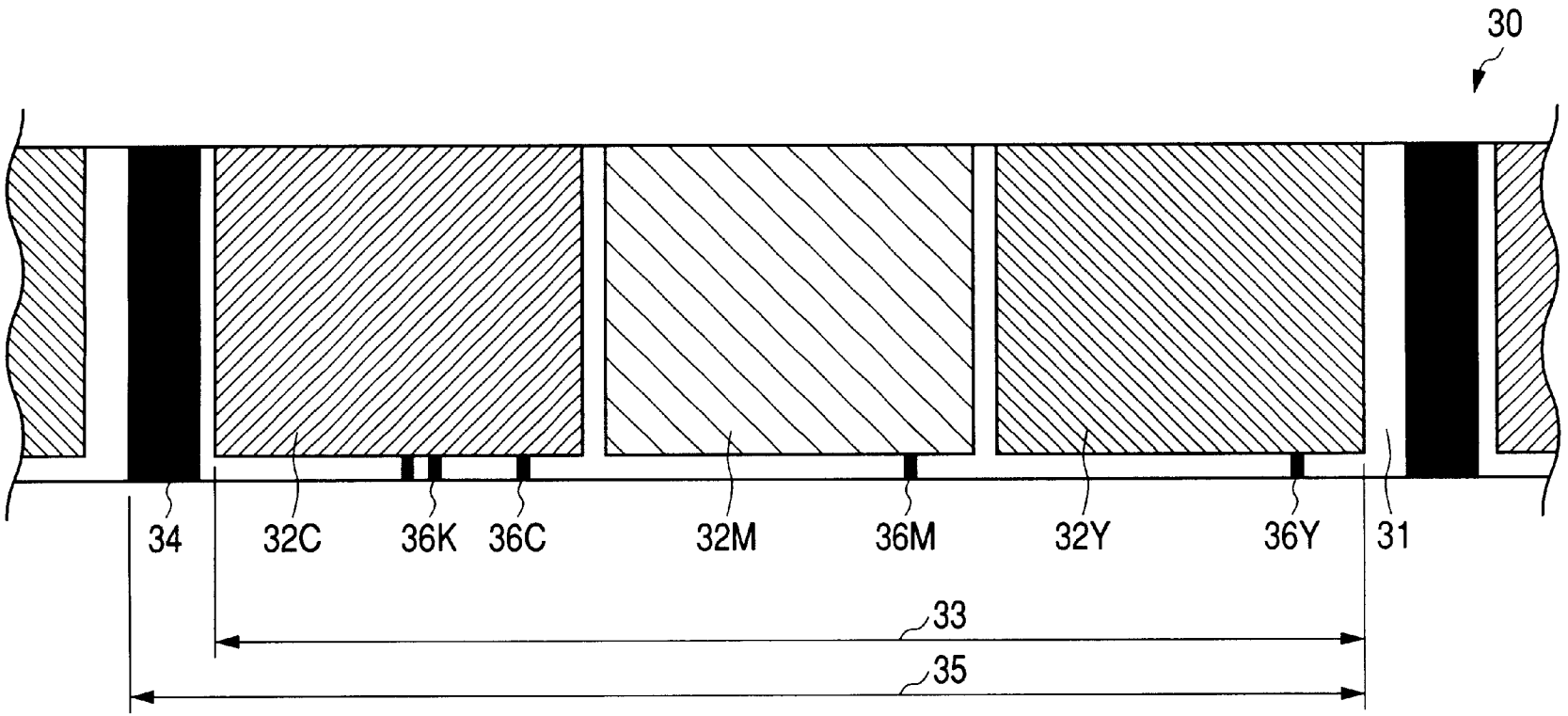
FIG. 5 is a plan view for describing the structure of a multicolor ink film shown in the second embodiment of an intermediate transfer recording apparatus in accordance with the present invention.

In the case where a full-color image is recorded as in the present embodiment, the present embodiment is different from the abovementioned first embodiment in that a multicolor ink film 30 having the structure as shown in FIG. 5 is used. As shown in FIG. 5, a unit recording cycle 33 comprising an ink region 32 of three colors, namely cyan (C) color, magenta (M) color, and yellow (Y) color, arranged in this order (C-color ink region 32C, M-color ink region 32M, and Y-color ink region 32Y) for forming a full-color image is arranged repeatedly on one side of a long film base material 31 formed of resin film consisting of PET in the longitudinal direction. The unit recording cycle 33 is used in the order successively from C-color ink region 320, M-color ink region 32M, to Y-color ink region 32Y when the primary transfer image 12 that is a reverse image is formed on the intermediate transfer film 8.

In the case of the multicolor ink film 30 used in the present embodiment, the K-color marker transfer ink region 34 is formed on the boundary between adjacent unit recording cycles 33 as the ink region that is exclusively used to form the register mark (not shown in the drawing) that serves as the positional reference when the primary transfer image 12 is formed on the intermediate transfer film 8 and the primary transfer image 12 is retransferred on a transfer medium 11. The combined region formed from one marker transfer ink region 34 and one unit recording cycle 33 disposed just after the marker transfer ink region 34 is regarded as one image forming recording cycle 35.

Furthermore, in the multicolor ink film 30 of the present embodiment, ink regions 32 of the respective colors, each of which ink region constitutes the unit recording cycle 33, are formed on one side of the film base material 31 on which the image forming recording cycle 35 is formed so that the narrow space of the bare film base material 31 remains on the other side edge of the film base material 31. On the bare narrow space, the marker transfer ink regions 34 that constitute the image forming recording cycle 35 and the detection markers 36 that detect the head position of each color ink region 32 that constitutes the unit recording cycle 33 are formed. Each of the detection markers 36 is a marker comprising one or more ink lines that extend in the width direction of the film base material 31. Each of the detection markers 36 is formed so that the rear end of the detection marker 36 is located at the position on the upstream side in the feeding direction of the multicolor ink film 30 from the head position of each color ink region 32, which is a component of the marker transfer ink region 34 and the unit recording cycle 33, separated by a desired distance.

A marker detection sensor (not shown in the drawing) provided in the recording apparatus body 1 detects a detection marker 36. Thereby, the head position of ink regions 32 and 34 indicated by means of the detection marker 36 is fed between the line thermal head 3 and the platen roller 2 of the recording apparatus body 1 in the intermediate transfer recording apparatus.

Figure 6:
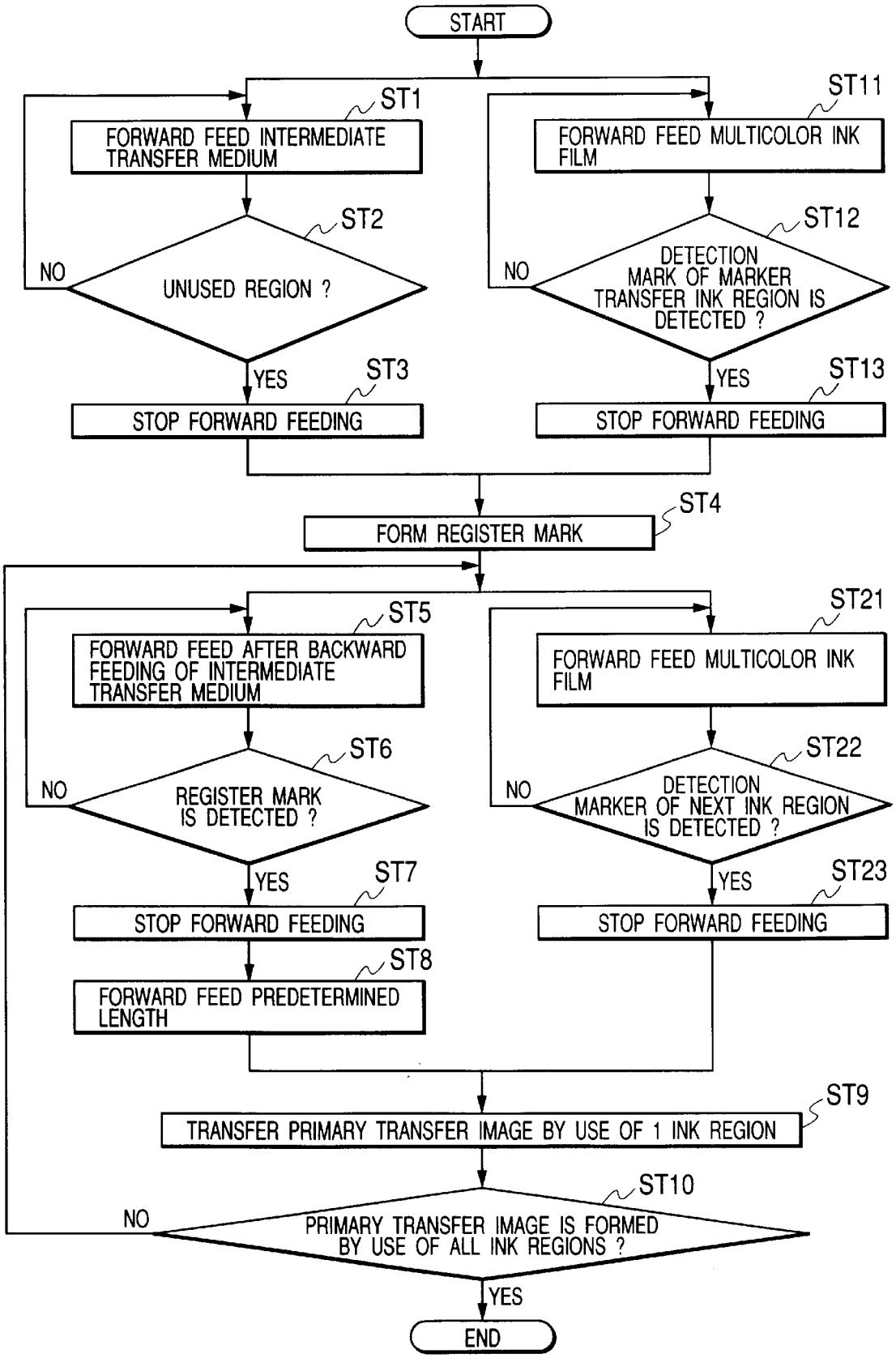
FIG. 6 is a flowchart showing the recording method for the recording of the primary transfer image onto the intermediate transfer film by use of the multicolor film shown in FIG. 5.

FIG. 6 is a flowchart showing the feeding control of the intermediate transfer film 8 fed when the primary transfer image 12 is formed, the feeding control of the multicolor ink film 30 relating to transfer of the register mark, and the feeding control of the multicolor ink film 30 that is used for forming the full-color primary transfer image by use of respective ink regions that constitute the unit recording cycle. All this feeding control is executed by means of a control section provided in the recording apparatus body 1 of the intermediate transfer recording apparatus of the present embodiment.

As shown in the flowchart, at first the intermediate transfer film feeding motor is driven in response to the command supplied from the control section when the line thermal head 3 starts to form an image on the intermediate transfer film 8 to thereby rotate the winding side roller 9*b*. The intermediate transfer film 8 is fed idly (step ST1), a sensor (not shown in the drawing) detects the unused region (step ST2), and the intermediate transfer film 8 is registered so that the head of the unused region is moved to the position of the recording section where the heating elements of the line thermal head 3 faces the platen roller 2 (step ST3).

On the other hand, the film feeding motor is driven to rotate the winding side film roller 5*b*, and the multicolor ink film 30 is fed in the feeding direction (step ST11). When a marker detection sensor (not shown in the drawing) provided in the recording apparatus body 1 detects the detection marker 36K that indicates the head position of the marker transfer ink region (step ST12), the feeding is stopped (step ST13). The line thermal head 3 is brought into contact with the platen roller 2 which is in the head down state, and a register mark is formed on the intermediate transfer film 8 by use of the marker transfer ink region 34 (step ST4).

Thereafter, the intermediate transfer film on which the register mark has been formed is moved backward temporarily so that the position where the register mark is formed is positioned on the upstream side of the feeding direction from the position where the marker detection sensor is disposed. In other words, the intermediate transfer film feeding motor is rotated reversely to rotate the feeding side film roller 5*a* reversely, the intermediate transfer film 8 is rewound and then fed in the forward direction again (step ST5), and the register mark formed on the intermediate transfer film 8 is aligned (step ST6 and step ST7). The intermediate transfer film 8 is fed idly by a predetermined length by the use of the register mark as a reference (step ST8).

On the other hand, in the case of the feeding control of the multicolor ink film 30, the film feeding motor is driven to feed the multicolor ink film 30 (step ST21), a detection marker 36C that indicates the head position of the C-color ink region 32C (step ST22), which is the ink region of the first color of the unit recording cycle 33, is detected, and the head position of the C-color ink region 32C is supplied to the recording section (step ST23).

A C-color reverse image for one picture is formed on the intermediate transfer film 8 by use of the C-color ink region 32C of the multicolor ink film 30 (step ST9). At that time, when the primary transfer image is formed, the dummy image 13 having a rectangular outside configuration is formed at the same time when the primary transfer image 12 is formed so that a narrow space of 1 to 2 mm is formed on the periphery of the circular primary transfer image 12 as in the case of the abovementioned first embodiment. At that time, the dummy image 13 may be formed with a thermal energy of the thermal head 3 that is lower than the thermal energy applied to the primary transfer image 12 so that the density of the dummy image 13 is lower than the density of the primary transfer image 12 as required.

Next, whether or not forming of the primary transfer image is completed by use of all the color regions of the unit recording cycle 33 is checked. If the formation of the primary transfer image is completed, then primary transfer image forming is brought to an end. On the other hand, if primary transfer image forming is not completed, then the sequence returns to the abovementioned step ST5 and step ST21 again.

In detail, the intermediate transfer film 8 that has been fed during C-color primary transfer image forming operation is moved backward to align the register mark formed on the intermediate transfer film 8. Simultaneously, according to the control method as described hereinabove, the detection marker 36M that indicates the head position of the M-color ink region 32M constituting the unit recording cycle 33 of the multicolor ink film 30 is detected. An M-color reverse image for a picture is formed on the C-color reverse image for one picture formed on the intermediate transfer film 8 by use of the M-color ink region 32M of the multicolor ink film 30 in the state that the head position of the M-color ink region 32M is supplied to the recording section. At that time, the M-color ink layer 32M may be additionally applied for double printing on the dummy image as required.

Subsequently, the intermediate transfer film that has been fed during M-color primary transfer image forming operation is moved backward by a predetermined length and then moved forward again to align the register mark formed on the intermediate transfer film 8 as in the case described hereinabove. Thereafter, the detection marker 36Y that indicates the head position of the Y-color ink region 32Y of the unit recording cycle 33 of the multicolor ink film 30 is detected. A Y-color reverse image for one picture is formed on the C-color and M-color reverse images for a picture formed on the intermediate transfer film 8 by use of the Y-color ink region 32Y of the multicolor ink film 30 in the state that the head position of the Y-color ink region 32Y is supplied to the recording section.

Thus, a desired reverse image that is the primary transfer image for one picture is formed on the intermediate transfer medium. At that time, the C-color ink layer 32C may be applied additionally on the dummy image as required.

The retransfer and recording of the primary transfer image on the intermediate transfer film 8, which has completed forming the primary transfer image and the dummy image onto the transfer medium, may be carried out in the same manner as in the abovementioned first embodiment. As a matter of course, the same effect as obtained in the abovementioned first embodiment can be obtained in the present embodiment.

The present invention is by no means limited to the abovementioned embodiments, and various modifications may be applied as required.

As described hereinbefore, according to the intermediate transfer recording apparatus in accordance with the present invention, a retransfer condition is optimized and a high quality recorded image can be formed on the recording medium because the image adhesion region can be maintained uniform throughout the process from the start of retransfer operation to the end of the operation when the primary image of the intermediate transfer film is retransferred onto a disk-like transfer medium.

In detail, a dummy image is formed on the region where the primary transfer image is not retransferred on the transfer medium on the periphery of the retransfer image region corresponding to the transfer medium when the primary transfer image is formed on the intermediate transfer film. Thereby, the dummy image is in contact with the upper surface of the guide member of the transfer medium of the periphery of the transfer medium when the primary image is retransferred onto the transfer medium, and heated and pressed by means of the heating means. The dummy image is retransferred in the same manner as when the primary image is retransferred onto the transfer medium. The retransfer region is maintained approximately constant throughout the retransfer operation, the peeling tension exerted on the intermediate transfer film is approximately even in the width direction, and the primary transfer image is retransferred onto the transfer medium without changing the transfer condition. As a result, an optimal retransfer condition can be obtained.

Because the dummy image is formed on the periphery of the primary transfer image with a predetermined space between the dummy image and the primary transfer image, retransfer of the dummy image onto the transfer medium is prevented even if the registration between the primary image and the transfer medium deviates slightly when the primary image is retransferred onto the transfer medium.

Also, because the outside peripheral configuration of the dummy image is rectangular, the retransfer region is maintained constant throughout the retransfer operation from the start when the primary image is retransferred onto the transfer medium. As a result a retransfer condition is optimized.

In addition, because the dummy image is formed with a density lower than that of the primary transfer image, the power supplied to the thermal head can be reduced for the dummy image forming region, and as a result power consumption can be minimized.

Furthermore, in the case where the dummy image is formed by the use of at least one color ink layer of the multicolor ink film, and the dummy image is formed with less thermal energy than that used for forming the primary transfer image, not only is power saved but also the time required to form the dummy image is shortened relative to the case in which all of the color ink layers are used to form the dummy image.

What is claimed is:

1. A transfer recording apparatus comprising:

a line thermal head for transferring ink of an ink film on an intermediate transfer film to form a primary transfer image, a transfer medium, and a retransfer means for forming a desired image on the transfer medium, wherein a dummy image is formed on a periphery of a retransfer image region on the transfer medium, and the primary transfer image is not retransferred when the primary transfer image is formed on the intermediate transfer film.

2. A transfer recording apparatus according to claim 1, wherein the dummy image is formed on a periphery of the primary transfer image with a predetermined space between the dummy image and the primary transfer image.

3. A transfer recording apparatus according to claim 2, wherein an outside peripheral configuration of the dummy image is rectangular.

4. A transfer recording apparatus according to claim 2, wherein the dummy image is formed with a density lower than that of the primary transfer image.

5. A transfer recording apparatus comprising:

a line thermal head for transferring ink of a multicolor ink film on an intermediate transfer film to form a primary transfer image, a transfer medium a retransfer means for forming a desired image on the transfer medium, wherein a dummy image is formed on a periphery of the retransfer image region on the transfer medium, and the primary transfer image is not retransferred when the primary transfer image is formed on the intermediate transfer film.

6. A transfer recording apparatus according to claim 5, wherein the dummy image is formed by using at least one color ink layer of the multicolor ink film, and the dummy image is formed with less thermal energy than that used for the primary transfer image.

7. A method of transferring images comprising driving a line thermal head to transfer ink of an ink film on an intermediate transfer film to form a primary transfer image, retransferring the primary transfer image on a transfer medium using a retransfer means to form a desired image on the transfer medium, and forming a dummy image on a periphery of a retransfer image region on the transfer medium, wherein the primary transfer image is not retransferred when the primary transfer image is formed on the intermediate transfer film.

8. A method according to claim 7, wherein the dummy image is formed on a periphery of the primary transfer image with a predetermined space between the dummy image and the primary transfer image.

9. A method according to claim 8, wherein an outside peripheral configuration of the dummy image is rectangular.

10. A method according to claim 8, wherein the dummy image is formed with a density lower than that of the primary transfer image.

11. A method of forming images comprising driving a line thermal head to transfer ink of a multicolor ink film on an intermediate transfer film to form a primary transfer image, retransferring the primary transfer image on a transfer medium using a retransfer means to form a desired image on the transfer medium, and forming a dummy image on a periphery of a retransfer image region on the transfer medium, wherein the primary transfer image is not retransferred when the primary transfer image is formed on the intermediate transfer film.

12. A method according to claim 11, wherein the dummy image is formed by using at least one color ink layer of the multicolor ink film, and the dummy image is formed with less thermal energy than that used for the primary transfer image.

* * * * *